US006733323B2

(12) United States Patent
Tso-Chin

(10) Patent No.: US 6,733,323 B2
(45) Date of Patent: May 11, 2004

(54) PULL TAB FOR EXTRACTING ELECTRICAL CONNECTOR

(75) Inventor: David Tso-Chin, Thousand Oaks, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/120,633

(22) Filed: Apr. 10, 2002

(65) Prior Publication Data

US 2003/0194903 A1 Oct. 16, 2003

(51) Int. Cl.[7] ..... H01R 13/00
(52) U.S. Cl. ..... 439/484; 439/610
(58) Field of Search ..... 439/484, 483, 439/476.1, 477, 607, 610, 581

(56) References Cited

U.S. PATENT DOCUMENTS 1,677,622 A * 7/1928 Dreuil ..... 439/483
3,997,234 A * 12/1976 Worman ..... 439/456
4,859,194 A * 8/1989 Bartholomew ..... 439/125
5,516,305 A * 5/1996 Haluska ..... 439/484
5,586,906 A * 12/1996 Staros et al. ..... 439/483
6,431,915 B1 * 8/2002 Ko ..... 439/610
6,506,075 B2 * 1/2003 Chiran et al. ..... 439/607

* cited by examiner

*Primary Examiner*—Hien D. Vu
(74) *Attorney, Agent, or Firm*—Wei Te Chung

(57) ABSTRACT

A pull tab (1, 3) is adapted to extract an L-shaped electrical connector (2) from a mating electrical device. The electrical connector includes a mating portion (20) and a cable-retaining portion (21) for retaining a cable (4). The pull tab has a strip-like configuration and includes an engaging portion (11, 31) and a handling portion (12, 32) extending from the engaging portion. The engaging portion exerts an extraction force on the connector. The handling portion is provided for facilitating manual extraction operation.

4 Claims, 5 Drawing Sheets

PULL TAB FOR EXTRACTING ELECTRICAL CONNECTOR

BACKGROUND OF THE INVENTION

1. Field of the Invention

The present invention relates to a pull tab, and more particularly, to a pull tab for extracting an electrical connector from an electrical device which mates with the electrical connector.

2. Description of Prior Art

To comply with the current trend of light weight and compactness, many electrical devices tend to employ small connectors such as cable connectors for transmitting signals. These connectors need to mate tightly with corresponding devices for transmitting signals reliably, which usually requires a great amount of applied force to extract these connectors from these devices when there is necessary to replace these connectors with other connectors for different applications. Their separation is normally accomplished by manually shaking the connectors (or perhaps with prying tools) when the connectors are pulled away from the devices. However, the shaking action to the connectors inevitably bends the contacts of the small connectors and damages the connectors and/or the devices. It is also difficult to manually pull a connector having a very small size.

In order to solve the above-mentioned problems, U.S. Pat. No. 4,961,256 discloses a conventional extraction tool. To separate an electrical connector from an electrical device, the extraction tool is inserted between the electrical connector and the electrical device. The tool is relatively thick so that it cannot be used for the present miniature electrical connector since there is no space large enough between the connector and the electrical device to accommodate the tool.

Japanese Publication for Laid-Open Patent Application No. 11-208461 discloses an extraction tab for extracting an L-type connector. The extraction tab defines an aperture surrounded by a peripheral portion for engaging with a tubular portion of the connector. The peripheral portion exerts an extracting force on the mating portion when extracting the connector. The peripheral portion has a relatively large width to ensure that the peripheral portion is strong enough in exerting the extracting force. However, such a peripheral portion occupies a relatively large space, which is adverse to the trend of compact size. Furthermore, since a large amount of extracting force is exerted on the mating portion of the connector, the mating portion tends to yield or becomes damaged after a long term of use, resulting in an unreliable connection of the connector with the electrical device.

Hence, an improved extraction tool is desired to overcome the above-mentioned shortcomings.

BRIEF SUMMARY OF THE INVENTION

The main object of the present invention is to provide a pull tab for extracting an electrical connector from a mating electrical device without affecting the electrical connection therebetween.

A pull tab in accordance with the present invention is adapted to extract an electrical connector from a mating electrical device.

The electrical connector comprises a mating portion and a cable-retaining portion perpendicularly extending from the mating portion for retaining a cable. The mating portion and the cable-retaining portion are both shielded by shells. A shell surrounding the mating portion forms a pair of wings to stand aside the mating portion for fitting with the outer periphery of the mating portion.

The pull tab has a strip-like configuration and comprises an engaging portion in a front thereof and a handling portion extending from the engaging portion. The engaging portion defines an opening surrounded by a peripheral portion. The profile of the opening is properly configured corresponding to an outer profile of the cable-retaining portion, thereby securely engaging with the cable-retaining portion. The handling portion is provided for facilitating manual extraction operation.

In use, by pulling the handling portion of the pull tab upwardly, the connector can be easily extracted from the device.

Other objects, advantages and novel features of the invention will become more apparent from the following detailed description when taken in conjunction with the accompanying drawings.

DETAILED DESCRIPTION OF THE INVENTION

Figure 1:
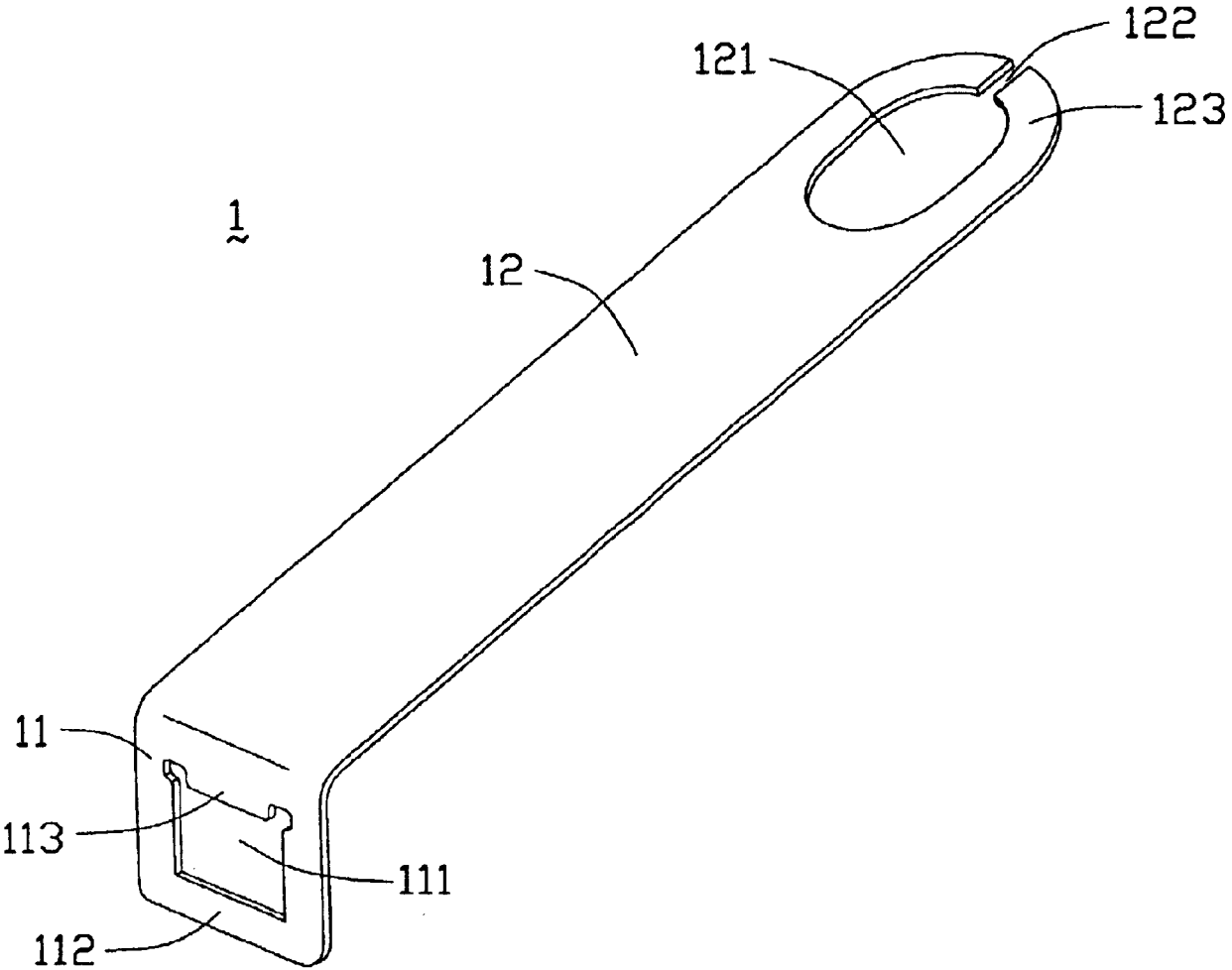
FIG. 1 is a perspective view of a pull tab according to a first embodiment of the present invention.
Figure 2:
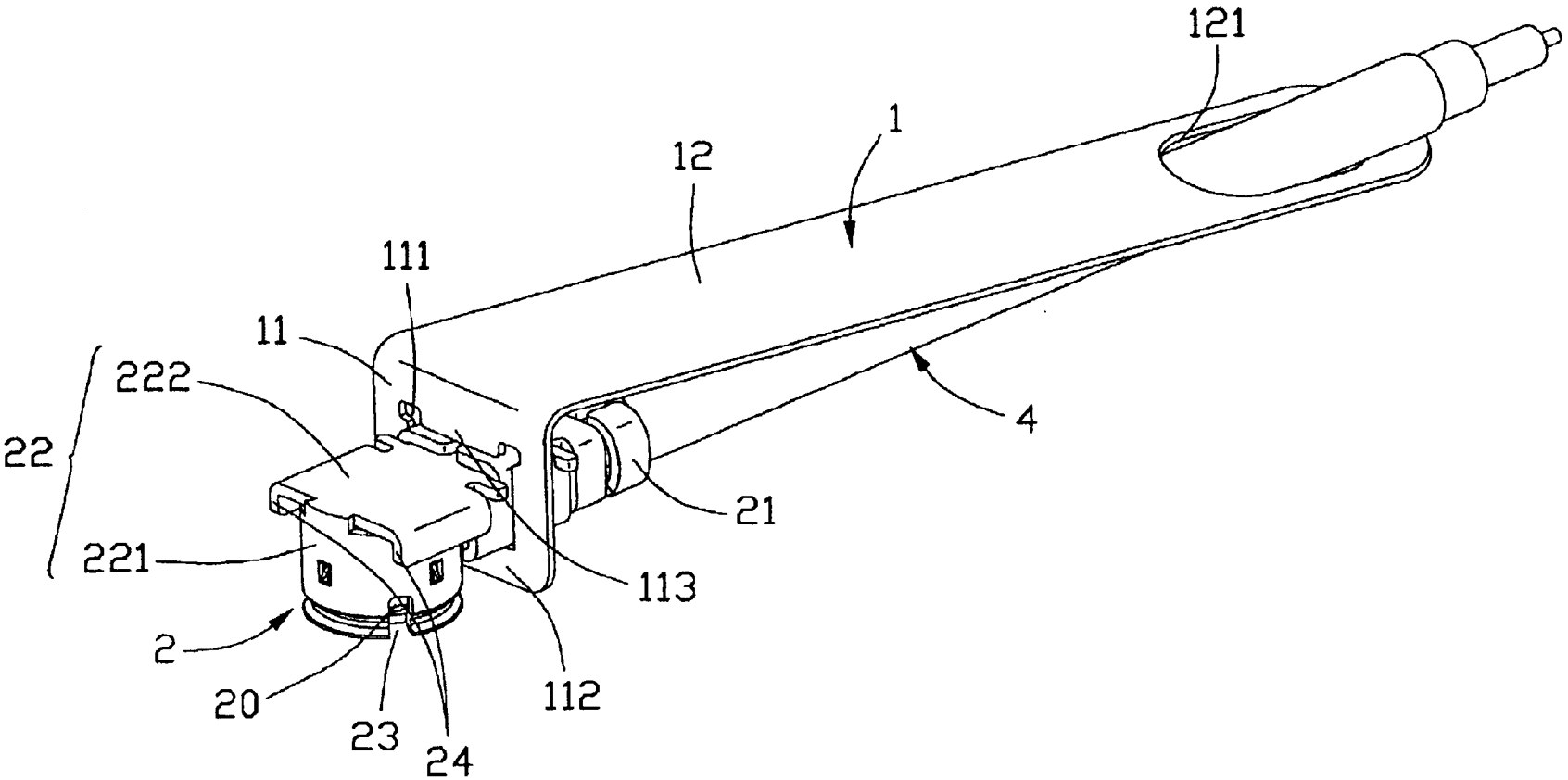
FIG. 2 is an assembled view of the pull tab shown in FIG. 1 and an electrical connector, in which the pull tab is retained to a cable.

As shown in FIGS. 1–2, a pull tab 1 according to a first embodiment of the present invention has an elongate and strip-like configuration.

The pull tab 1 is provided to extract an electrical connector 2 from an electrical device (not shown) which mates with the connector 2. In this preferred embodiment, the connector 2 is an RF (Radio Frequency) cable connector having an L-shaped configuration. The RF cable connector 2 is the one disclosed in U.S. Pat. No. 6,340,312 B1, invented by the same inventor of the present application and assigned to the same assignee. The whole disclosure of the '312 B1 patent is incorporated herein by reference. The RF cable connector 2 comprises an upright mating portion 20 and a cable-retaining portion 21 for retaining a cable 4. The cable-retaining portion 21 extends horizontally and rearwardly from an upper section of the mating portion 20. The mating portion 20 defines a mating mouth 23 in a bottom thereof for mating with a complementary portion of the electrical device. The mating portion 20 has a shell 22 covering thereon. The shell 22 has a tubular portion 221 enclosing a circular periphery of the mating portion 20 and a planar portion 222 covering an upper surface of the mating portion 20. The planar portion 222 forms a pair of wings 24 extending downwardly from opposite sides thereof for engaging with an outer periphery of the tubular portion 221.

The pull tab 1 is made of resilient material. The pull tab 1 has an upright engaging panel 11 in a front thereof and a handling panel 12 extending rearwardly and upwardly from an upper edge of the upright panel 11 substantially at a right angle. The engaging panel 11 defines a substantially rectangular opening 111 in a central portion thereof and forms a rectangular peripheral portion 112 around the opening 111. The profile of the opening 111 is properly configured corresponding to an outer profile of a front portion of the cable-retaining portion 21. Thus, the engaging panel 11 is firmly engaged with the cable-retaining portion 21. A patch 113 projects into the opening 111 for abutting against the cable-retaining portion 21. The handling panel 12 defines a retaining aperture 121 in a rear end thereof distant from the engaging panel 11. The retaining aperture 121 is surrounded by a peripheral margin 123. The aperture 121 engages with the cable 4 for retaining the handling panel 12 to the cable 4, thereby preventing the handling panel 12 from extending above the connector 2 when the pull tab 1 is not used. A break 122 is axially defined through the rear end of the handling panel 12 and communicates with the aperture 121. The break 122 allows for an extension of the cable 4 through the rear end of the handling panel 12 to be retained in the aperture 121.

Figure 3:
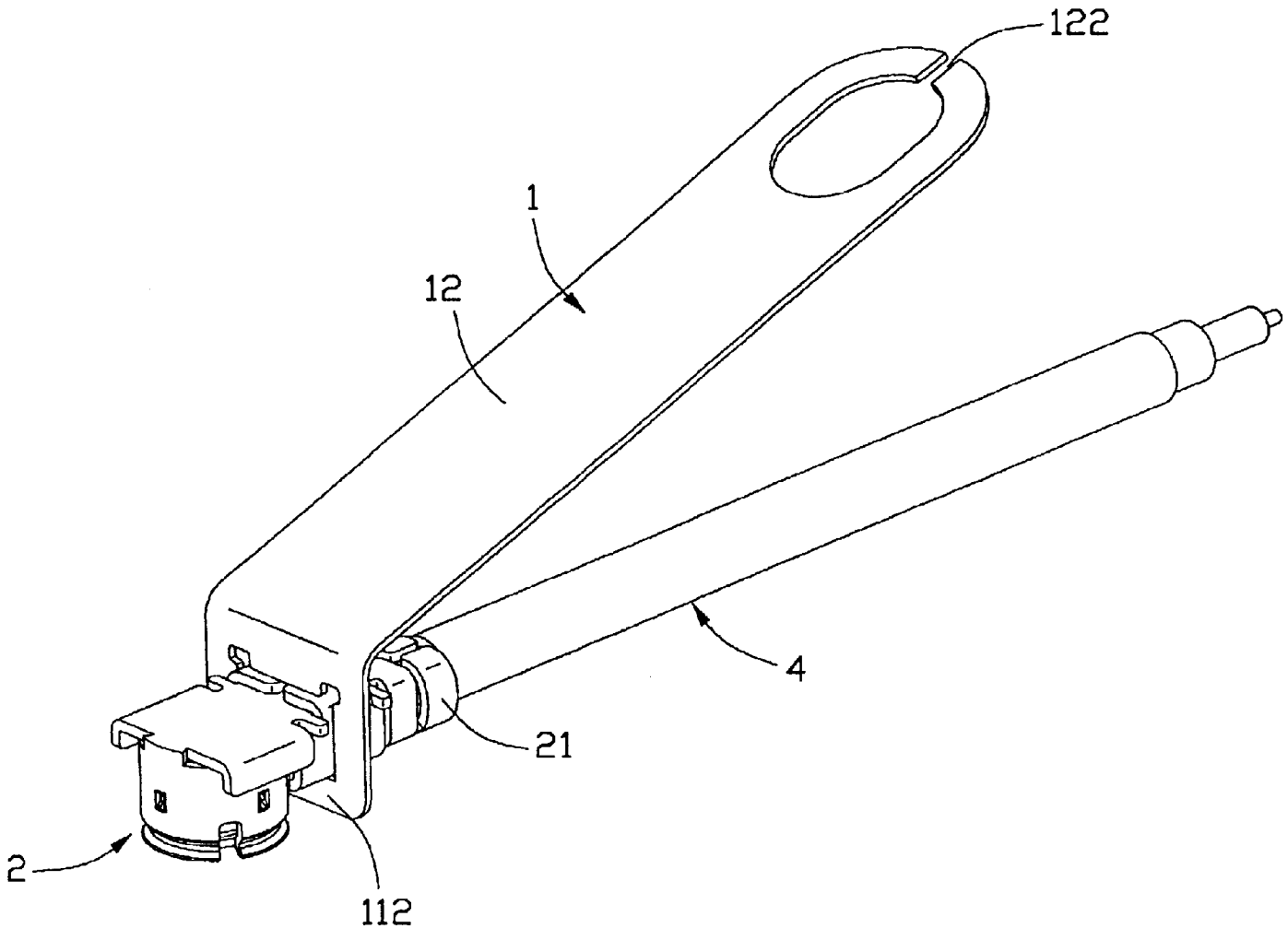
FIG. 3 is a view similar to FIG. 2, illustrating the pull tab in a free state ready to be used to extract the connector.

In use, referring to FIG. 3, by freeing the handling panel 12 from the cable 4 via the break 122, the handling panel 12 moves into a free state above the cable 4. Holding and upwardly pulling the handling panel 12 of the pull tab 1, the peripheral portion 112 exerts an upper extracting force on the cable-retaining portion 21, thereby upwardly pulling the connector 2 out of the device.

Figure 4:
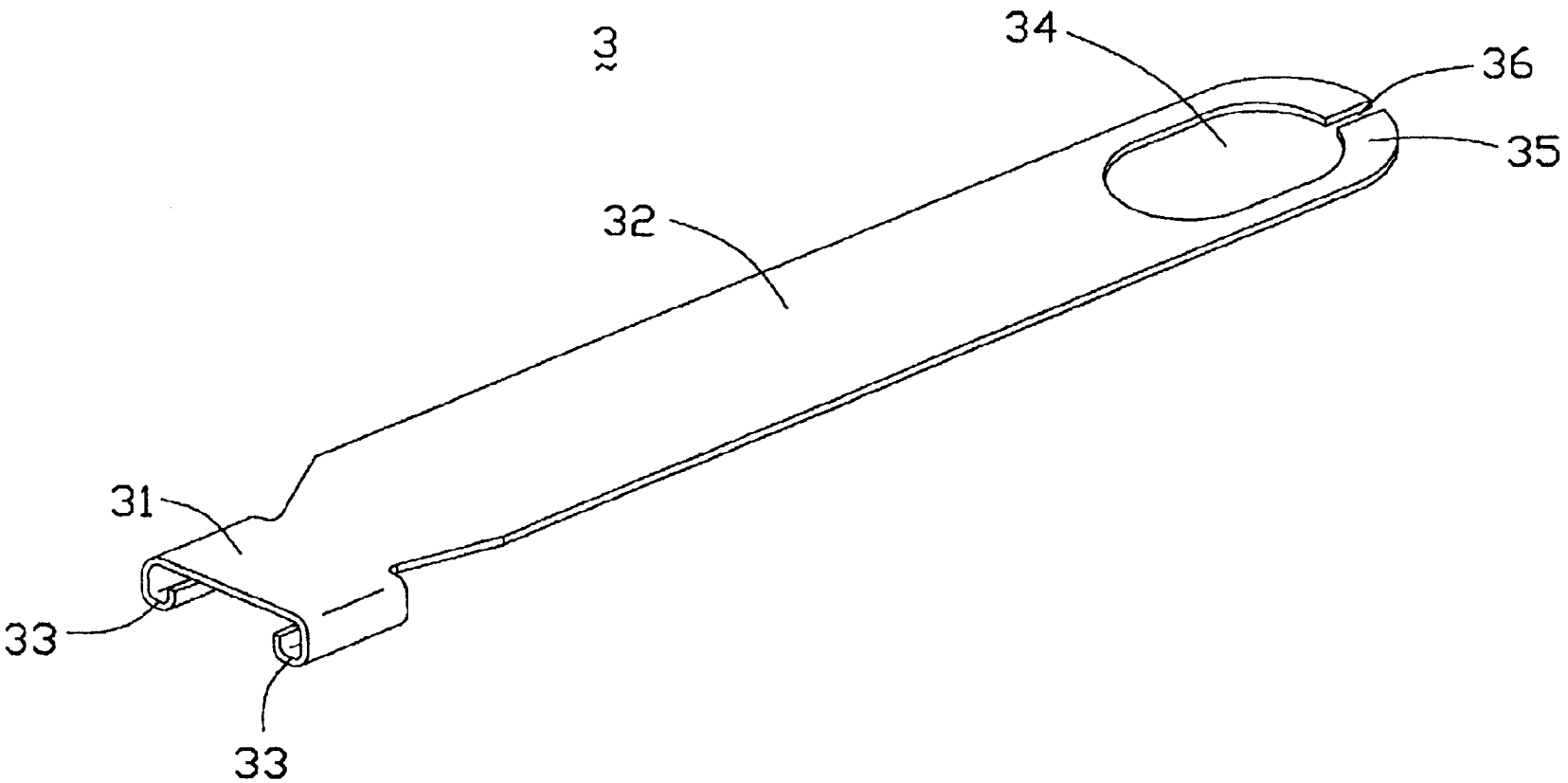
FIG. 4 is a perspective view of a pull tab according to a second embodiment of the present invention.
Figure 5:
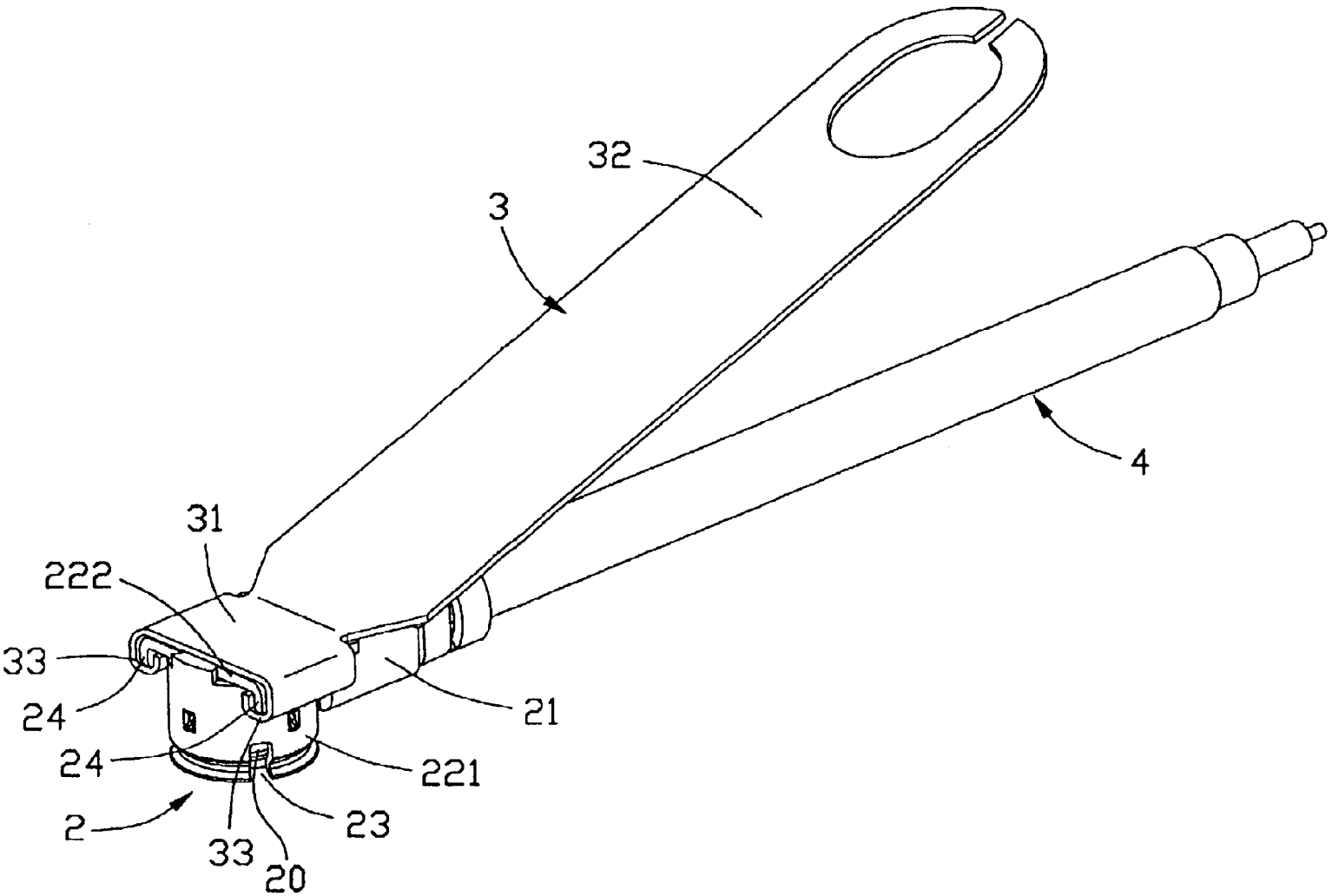
FIG. 5 is a view similar to FIG. 2, illustrating a use of the pull tab of FIG. 4 for extracting the electrical connector.

Referring to FIGS. 4 and 5, a pull tab 3 according to a second embodiment of the present invention comprises a horizontal engaging section 31 and a handling section 32 rearwardly extending from the engaging section 31. A pair of hooks 33 extends downwardly and inwardly from opposite sides of the engaging section 31. In assembly, the hooks 33 of the pull tab 3 are pushed to engage respectively with the wings 24 of the connector 2. The handling section 32 defines a retaining aperture 34 surrounded by a peripheral margin 35 for retaining the handling section 32 on the cable 4 when the pull tab 3 is not used. A break 36 is defined through a rear end of the handling section 32 and communicates with the aperture 34 for facilitating engaging the aperture 34 with the cable 4. Regarding the structure and use of the retaining aperture 34, the peripheral margin 35 and the break 36, they are the same as those of the aperture 121, the peripheral margin 123 and the break 122 of the first embodiment. In use, by freeing the handling section 32 from the cable 4 and upwardly pulling the pull tab 3, the hooks 33 exert an upper extraction force on the wings 24 to extract the connector 2 from the device.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

a cable connector comprising a mating portion and a metal cable-retaining portion perpendicularly extending from the mating portion adapted for retaining a cable; and a pull tab for extracting the cable connector from a mating electrical device, comprising:

an engaging portion comprising a rectangular opening surrounded by a rectangular peripheral portion, the peripheral portion engaging with the cable-retaining portion; and a handling portion substantially perpendicularly extending from the engaging portion adapted for receiving an extracting force; wherein the engaging portion has a patch projecting from an edge thereof and extending into the opening for abutting against a horizontal portion of the metal cable-retaining portion.

2. The cable connector assembly as claimed in claim 1, wherein the handling portion of the pull tab comprises an aperture and a peripheral margin around the aperture adapted for engaging with the cable, the handling portion defining a break therethrough communicating with the aperture, said break being adapted for facilitating the engagement of the cable in the aperture.

3. A pull tab for extracting a cable connector from a mating electrical device, the cable connector comprising a connector including a metal cable-retaining portion and a cable connecting with the metal cable-retaining portion, the pull tab comprising:

an engaging portion adapted for engaging with connector; and a handling portion extending from the engaging portion, the handling portion having an aperture at an end thereof distant from the engaging portion, said aperture being adapted for removably retaining the cable therein, the handling portion receiving an extracting force in a direction substantially perpendicular to the cable for extracting the connector from the mating electrical device when the cable is not retained in the aperture; wherein the engaging portion is a rectangular panel defining a rectangular opening therein, the rectangular opening being adapted for fittingly receiving a horizontal portion of the metal cable-retaining portion; wherein the engaging portion has a patch projecting from an edge thereof and into the opening for engaging the horizontal portion of the metal cable-retaining portion.

4. The pull tab as claimed in claim 3, wherein the handling portion defines a break communicating with the aperture, the break being adapted for facilitating the cable to be removably retained in the aperture.

* * * * *